US006644779B2

(12) United States Patent
Aldrich et al.

(10) Patent No.: US 6,644,779 B2
(45) Date of Patent: Nov. 11, 2003

(54) ROTATING WASTE INK ACCUMULATION SYSTEM

(75) Inventors: Charles Stanley Aldrich, Nicholasville, KY (US); Martin Alan Johnson, Winchester, KY (US); Herman Anthony Smith, Winchester, KY (US); Randal Scott Williamson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/957,096

(22) Filed: Sep. 20, 2001

(65) Prior Publication Data

US 2003/0052940 A1 Mar. 20, 2003

(51) Int. Cl.[7] ..... B91J 2/165
(52) U.S. Cl. ..... 347/36; 347/35
(58) Field of Search ..... 347/36, 29, 32, 347/35

(56) References Cited

U.S. PATENT DOCUMENTS

| | | | | |
|---|---|---|---|---|
| 4,567,494 A | | 1/1986 | Taylor | 347/30 |
| 4,701,771 A | | 10/1987 | Ikeda | 347/36 |
| 4,800,403 A | | 1/1989 | Accattino et al. | 347/30 |
| 5,500,659 A | | 3/1996 | Curran, Jr. et al. | 347/28 |
| 5,614,930 A | | 3/1997 | Osborne et al. | 347/33 |
| 5,617,124 A | | 4/1997 | Taylor et al. | 347/35 |
| 5,677,715 A | * | 10/1997 | Beck | 347/29 |
| 5,712,668 A | | 1/1998 | Osborne et al. | 347/32 |
| 5,896,145 A | | 4/1999 | Osborne et al. | 347/33 |
| 6,003,983 A | | 12/1999 | Lowry et al. | 347/85 |
| 6,082,848 A | | 7/2000 | Taylor | 347/35 |
| 6,196,657 B1 | | 3/2001 | Hawkins et al. | 347/28 |
| 6,203,138 B1 | | 3/2001 | Hirabayashi et al. | 347/36 |
| 6,217,153 B1 | | 4/2001 | Silverbrook | 347/54 |
| 6,247,783 B1 | | 6/2001 | Shibata et al. | 347/35 |
| 6,273,547 B1 | | 8/2001 | Aldrich | 347/36 |
| 6,340,220 B1 | * | 1/2002 | Gaylor et al. | 347/35 |

* cited by examiner

*Primary Examiner*—Shih-wen Hsieh
(74) *Attorney, Agent, or Firm*—Ronald K. Aust

(57) ABSTRACT

A waste ink accumulation system in an ink jet printer includes a rotatable body having an ink-collecting surface and a plurality of projections extending from the ink-collecting surface. An actuating mechanism rotates the body.

20 Claims, 3 Drawing Sheets

ROTATING WASTE INK ACCUMULATION SYSTEM

BACKGROUND OF THE INVENTION

1. Field of the Invention

The present invention relates to an ink jet printer, and, more particularly, to a waste ink accumulation system for an ink jet printer.

2. Description of the Related Art

Ink jet printers require maintenance operations to keep the nozzles of the print cartridge operating properly. Such maintenance operations typically include the steps of wiping the nozzle area of the print cartridge, firing the nozzles at prescribed intervals to purge the nozzles (spitting), and capping the cartridge during idle periods to prevent the jetted ink which remains on the nozzle plate from drying and clogging one or more of the nozzles of the nozzle plate. Typically, the spitting operation occurs at a location in the maintenance station. Over a period of time, the solids in the waste ink accumulate in the maintenance station, and the resulting waste ink buildup can affect the operation of the maintenance assembly.

It is possible for a stalagmite of dry waste ink to form in the base of the ink well in the maintenance station. The waste ink is the result of normal operation of an ink jet printer. As the height of the stalagmite grows, it can at some point interfere with the maintenance sled or print cartridge causing failure in the printer. The chance of failure due to such a stalagmite has greatly increased in recent years due to the rise in the number of nozzles in a print cartridge and higher frequency of maintenance. In the past, printers have used a felt pad to absorb the waste ink, which is sufficient for slow drying inks and/or low solid content in the ink, but it is not sufficient for fast drying and high solid content inks.

In a waste ink accumulation system, the waste ink migrates to wherever the ink originally dries. The surface area available for drying is limited to the inner surface of the body for accumulating the inks. In addition, the ink begins forming solid piles of ink as it accumulates and dries. A problem is that if the printer is not level, or the printer is tipped, the ink piles can tip, fall out and cause contamination to other parts of the printer.

What is needed in the art is a waste ink accumulation system that prevents the growth of ink stalagmites and that prevents piles of waste ink from falling out of the waste ink receptacle.

SUMMARY OF THE INVENTION

The present invention provides a system including a horizontally rotating cup for catching waste ink from an ink jet printer and redistributing it around a spiked body of the cup. The cup is rotated using the energy of the printhead carrier during normal operation. The rotating cup is designed such that the waste ink builds in a circular fashion around the body of the cup rather than building on a center point, thus preventing the formation of a stalagmite.

The rotating waste ink accumulation system is a passively energized system whereby the energy to actuate the system is provided by the normal primary function of the printer.

The system uses a horizontally rotating cup to catch the waste ink. The cup is designed with teeth to rotate systematically as a gear while freely riding a rub ring on the body of the cup. The horizontal rotation distributes the ink in a large area to prevent stalagmite formation at a central point.

The cup has a matrix of spikes to provide both larger surface area for ink migration and also a skeletal system for the dried waste ink, which prevents tipping of ink piles.

The cup is rotated in a ratcheting motion by an actuator wall, using a cylindrical plunger and receiving hole to restrict the direction of motion. The actuator wall is self-resetting to avoid adding any energy to the primary operation of the printer. The actuator wall is driven by the carrier-driven maintenance sled feature as the printhead carrier goes into the maintenance station capping position (in-stroke) and out of the maintenance station capping position, which freely releases the actuator wall, all staying within a linear motion.

The invention comprises, in one form thereof, a waste ink accumulation system in an ink jet printer. A rotatable body has an ink-collecting surface and a plurality of projections extending from the ink-collecting surface. An actuating mechanism rotates the body.

An advantage of the present invention is that the buildup of waste ink is prevented, thus avoiding functional failure of the primary maintenance system.

Another advantage is that the waste ink accumulation system is passively energized. The energy drawn from the primary function of the printer is negligible. Therefore, no energy source is required to be to be added to the base printer via motor, solenoid or any other means.

Yet another advantage is that the spikes in the base of the cup aid in holding the ink mounds from rolling out of the cup when the printer is tilted.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
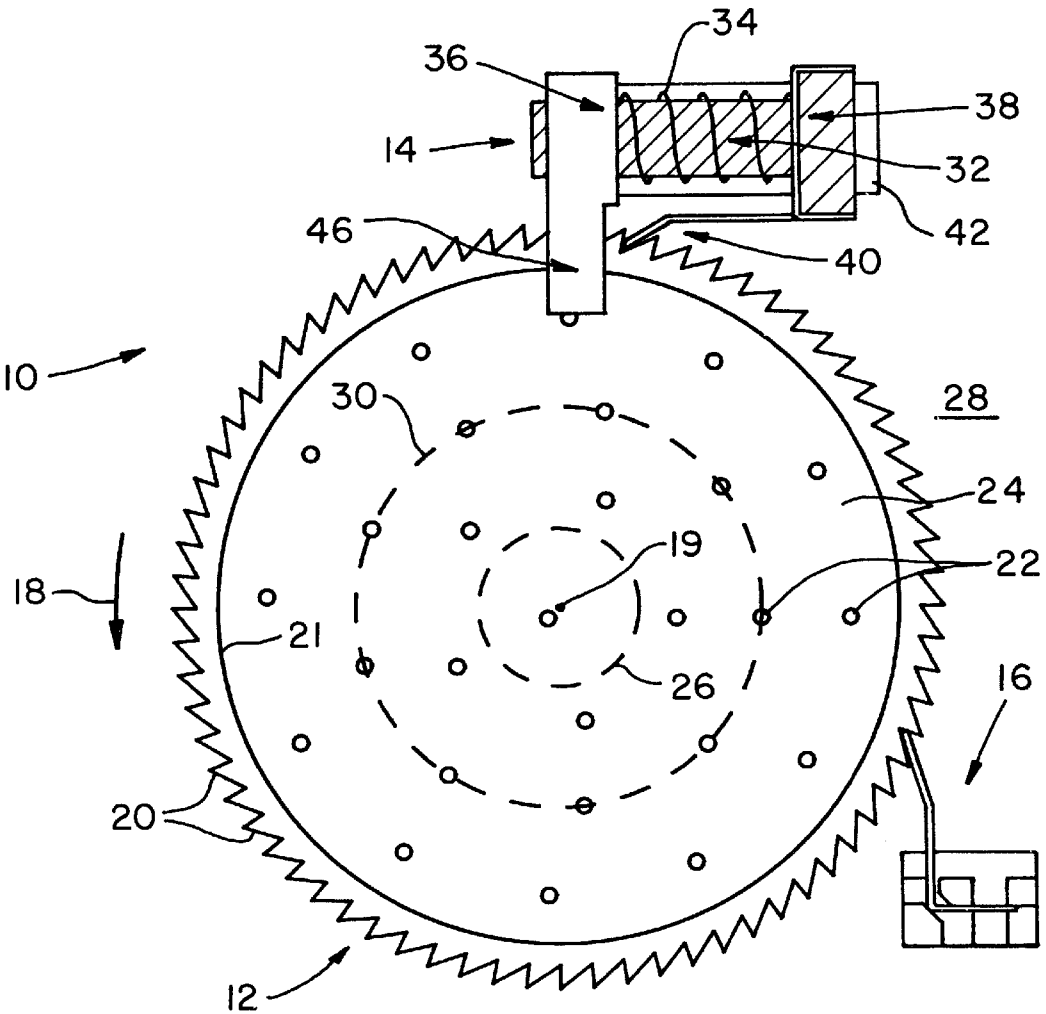
FIG. 1 is a top view of one embodiment of a waste ink accumulation system of the present invention.

Referring now to the drawings and particularly to FIG. 1, there is shown one embodiment of a rotating waste ink accumulation system 10 of the present invention including a rotating cup 12, an actuating mechanism 14 and a back stop spring urged pawl in the form of a back stop leaf spring 16.

Cup 12 is positioned to receive the waste ink directly from a printhead of the printer in the maintenance station. Rotating cup 12 is horizontally oriented and rotates in a horizontal plane, as indicated by arrow 18. That is, cup 12 rotates about a vertical axis 19 that is perpendicular to the planar ink-collecting surface of cup 12. Cup 12 has eighty teeth 20 evenly spaced about the periphery of cup 12. Thus, each tooth 20 is spaced 4.5 degrees from each adjacent tooth 20. A vertical wall 21 surrounds the circular ink-collecting surface of cup 12. Cup 12 has a matrix of projections in the form of conically-shaped spikes 22 extending from an ink-collecting surface of cup body 24. Extruding and extending from the bottom of cup 12 is a center post 26 which locates the center for rotation. Post 26 is rotatably attached or connected to a fixed base 28 of the printer.

Cup 12 includes a rub ring 30 that is extruded from or engages a second side of body 24 of cup 12. The second side of body 24 is opposite the ink-collecting surface of cup 12. Ring 30 is concentric relative to the center of cup 12 at vertical axis 19. Ring 30 lowers the amount of surface area on base 28 of the printer that is in contact with cup 12. Thus, an easier, lower friction rotation of cup 12 is enabled. The smaller surface area reduces the drag in the rotation. Ring 30 is located a distance away from the edge of cup 12 in order to avoid ink contamination in the contact area between ring 30 and printer base 28.

Figure 2:
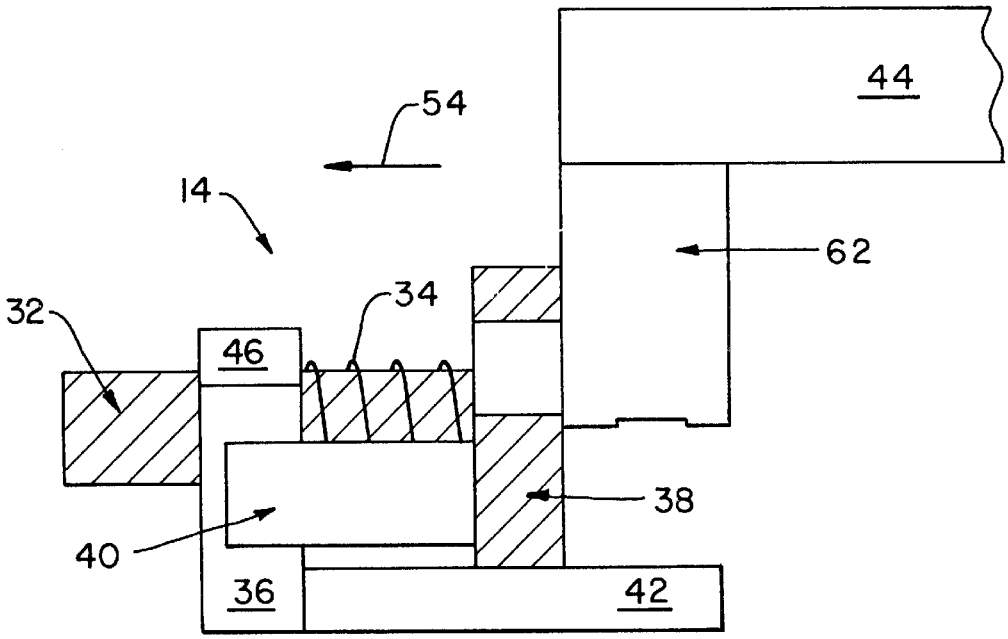
FIG. 2 is a front view of the actuating mechanism of FIG. 1.
Figure 3:
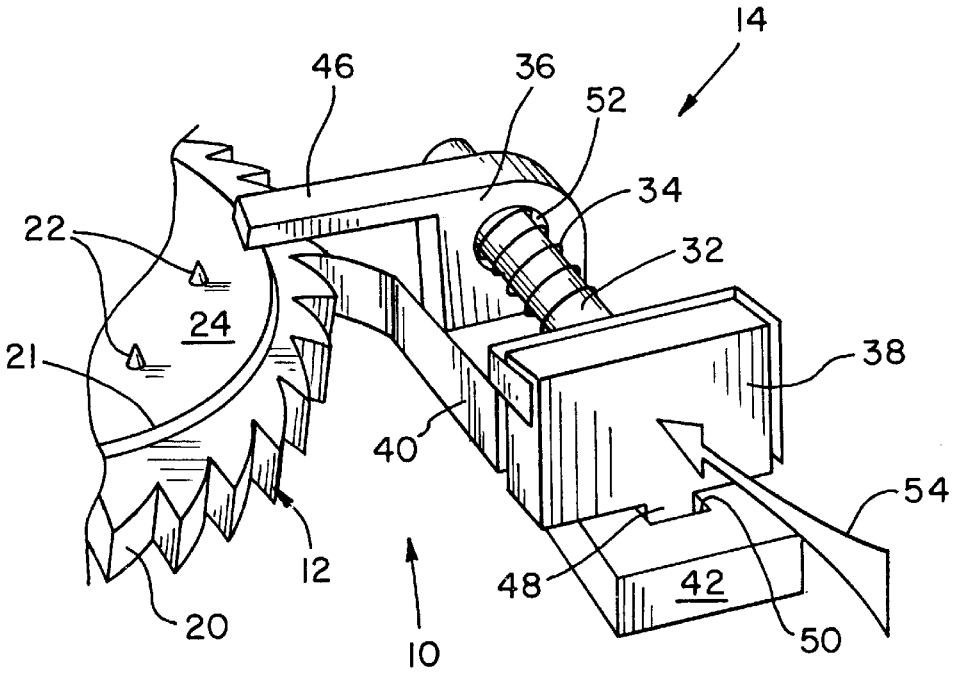
FIG. 3 is a fragmentary, perspective view of the waste ink accumulation system of FIG. 1.

Actuating mechanism 14 includes a plunger 32, a return compression spring 34, a fixed guide wall 36, a movable actuator wall 38, a plunger spring urged pawl in the form of a plunger leaf spring 40, an actuator base 42 and a maintenance sled 44 (FIG. 2) of a maintenance station. Guide wall 36 includes a retaining wall or upstop 46 in the form of a flat arm extruding out over the edge of rotating cup 12 for retaining cup 12. Actuator wall 38 has a leg 48 (FIG. 3) extruded off of its bottom. Leg 48 rides a groove 50 in actuator base 42. Guide wall 36 includes a throughhole 52 which receives plunger 32. The diameter of throughhole 52 is slightly larger than that of plunger 32.

Rotating cup 12 and actuator wall 38 are made from a different plastic material than that of base 28 of the printer. The different materials allow the friction coefficients to be low, which makes the system more efficient. Body 24 of rotating cup 12 and actuator wall 38 are positioned above the normal level of the felt pad in order to prevent contamination from other ink.

In operation, the stroke for rotation is provided by actuator wall 38, which is fixed with leaf spring 40. Plunger 32 acts as a plunger going through throughhole 52 in guide wall 36. Throughhole 52 limits the movement of plunger 32 to only one plane of direction. A sufficient thickness is added to guide wall 36 for restricting the movement in two planes. Upstop 46 prevents cup 12 from tilting due to the force vectors of leaf springs 16, 40. Plunger leaf spring 40 is attached to actuator wall 38 so that it is angled into teeth 20 of rotating cup 12. The angle is such that the beam strength of plunger leaf spring 40 moves cup 12, but it is a large enough angle so that plunger leaf spring 40 can travel back over teeth 20 of cup 12 without reversing the rotation of cup 12.

Figure 4:
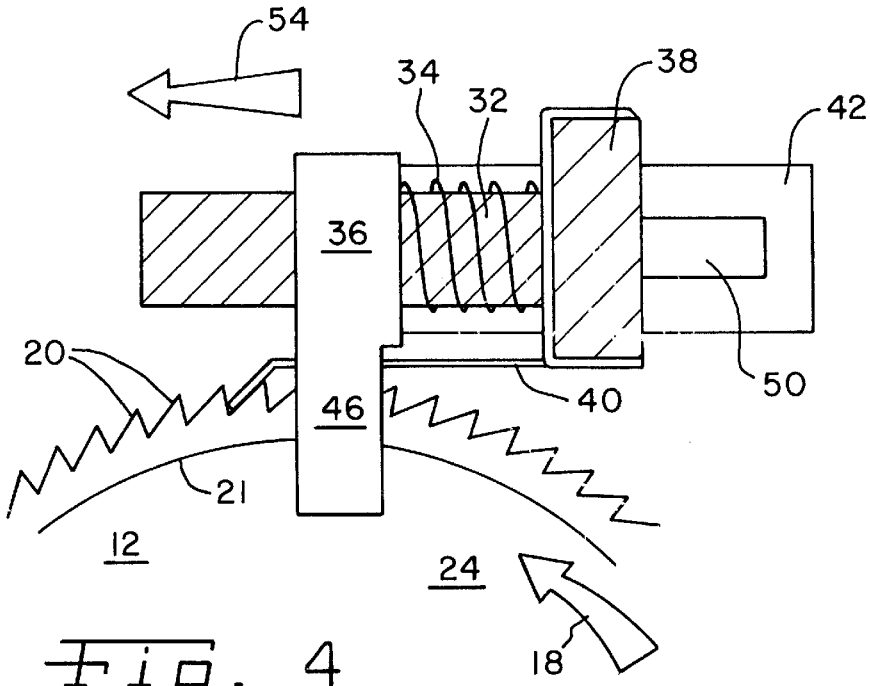
FIG. 4 is a fragmentary, top view of the waste ink accumulation system of FIG. 1 with the actuating mechanism in an actuated position.

As actuator wall 38 moves in direction 54, as shown in FIG. 4, plunger leaf spring 40 moves rotating cup 12 in direction 18 a distance corresponding to one or two teeth 20, i.e., 4.5 or 9.0 degrees. A certain amount of play in the rotational position of cup 12 is the reason for the uncertainty of whether cup 12 will turn one or two teeth per stroke of plunger 32. This motion of plunger 32 in direction 54 is the in-stroke. Thus, cup 12 rotates 4.5 or 9.0 degrees for each stroke of actuator wall 38.

Figure 5:
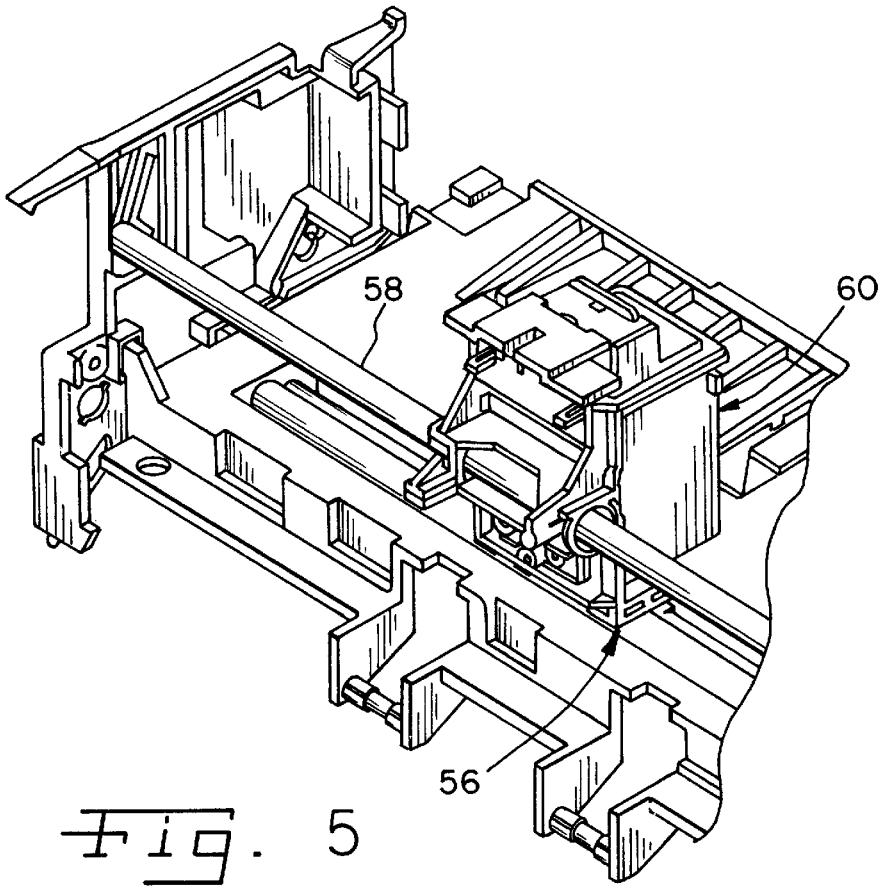
FIG. 5 is a perspective view of a portion of a printer showing an ink jet printhead used in conjunction with the waste ink accumulation system of FIG. 1.

The entire system 10 is energized by the motion of print head carrier 56 (FIG. 5) along guide rod 58 into normal cap position in a maintenance station. Print head carrier 56 carries a printhead 60 and pushes sled 44 in direction 54. Actuator wall 38 is moved by a feature 62 protruding off of the base of the maintenance sled 44 as sled 44 moves into cap position. Feature 62 of sled 44 pushes actuator wall 38 into the in-stroke position. Sled feature 62 is powered by print head carrier 56 as carrier 56 moves into the normal home position, thereby providing a low energy, passive system. Thus, the energy added to the normal maintenance function is minimal, allowing it to operate without disturbance.

The out-stroke in a direction opposite to direction 54 is provided by return spring 34, which is positioned on and surrounds plunger 32 of actuator wall 38. As carrier 56 moves out of the home position, rotating waste ink accumulation system 10 is no longer connected to sled feature 62, so it must reset itself. The out-stroke resets actuator wall 38 by using very light force compression spring 34 to push actuator wall 38 to its initial position. A first end of compression spring 34 engages guide wall 36, and a second end of compression spring 34 engages actuator wall 38. The force on compression spring 34 is such that it adds a negligible amount of force or resistance to the movement of carrier 56.

Back stop leaf spring 16 exerts a negligible normal force on cup 12 and is positioned in base 28 of the printer in order to prevent cup 12 from rotating back with actuator wall 38. Back stop leaf spring 16 is angled to allow cup 12 to rotate for the in-stroke, and it provides enough beam strength to prevent cup 12 from rotating during the out-stroke. Plunger leaf spring 40 on actuator wall 38 has the proper angle needed to move in the same motion with actuator wall 38 as it resets while providing very little drag on cup 12.

The array of spikes 22 inside the waste ink accumulation cup 12 provides additional surface area for the waste ink to migrate onto. The array of spikes 22 allows for an even distribution of solidifying ink piles as the buildup of waste ink accumulates. Spikes 22 also provide a type of skeletal system for the ink piles, which aid in preventing the piles of ink from becoming dislodged from waste ink cup 12. Spikes 22 are small enough to allow for the bulk of the waste ink to be collected on body 24 of cup 12. Yet, spikes 22 are large enough to allow for the functionality needed for increasing the surface area and providing a skeleton for the solidified waste ink accumulation. Spikes 22 hold the dry piles of ink stationary should the machine become unbalanced or tilted.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet printer, comprising:

a printhead;

a body configured to receive waste ink from said printhead; and a carrier configured to carry said printhead and rotate said body about an axis passing through said body.

2. An ink jet printer, comprising:

a printhead;

a body configured to receive waste ink from said printhead;

a carrier configured to carry said printhead and rotate said body; and an actuating mechanism configured to rotate said body in response to movement of said carrier.

3. The ink jet printer of claim 2, further comprising a sled configured to move at least a part of said actuating mechanism in response to being pushed by said carrier.

4. The ink jet printer of claim 2, wherein said body includes a plurality of teeth, said actuating mechanism being configured to engage said teeth.

5. The ink jet printer of claim 4, wherein said actuating mechanism includes a plunger spring urged pawl configured to engage said teeth and move in a first linear direction to thereby rotate said body in a first rotational direction.

6. The ink jet printer of claim 5, wherein said actuating mechanism includes a return spring configured to move said plunger spring urged pawl in a second linear direction substantially opposite to said first linear direction after said plunger spring urged pawl has rotated said body.

7. The ink jet printer of claim 6, wherein said actuating mechanism includes a movable part and a fixed part, said plunger spring urged pawl being attached to said movable part, said return spring having a first end and a second end, said first end engaging said movable part, said second end engaging said fixed part.

8. The ink jet printer of claim 7, wherein said actuating mechanism includes a plunger attached to said movable part, said return spring being attached to said plunger.

9. The ink jet printer of claim 7, wherein said fixed part of said actuating mechanism includes a retaining wall configured for retaining said body.

10. The ink jet printer of claim 5, further comprising a back stop spring urged pawl configured to engage said teeth and prevent said body from rotating in a second rotational direction substantially opposite to said first rotational direction.

11. A waste ink accumulation system in an ink jet printer, said system comprising:

a rotatable body having an ink-collecting surface and a plurality of projections extending from said ink-collecting surface; and an actuating mechanism configured to rotate said body.

12. The waste ink accumulation system of claim 11, wherein said projections are configured to collect waste ink and retain the waste ink on said rotatable body.

13. The waste ink accumulation system of claim 11, wherein said projections comprise conically-shaped spikes.

14. The waste ink accumulation system of claim 11, wherein said rotatable body comprises a cup.

15. A waste ink accumulation system in an ink jet printer, said system comprising:

a body having an ink-collecting surface positioned to receive waste ink directly from a printhead, said body being rotatable about an axis substantially perpendicular to said ink-collecting surface; and an actuating mechanism configured to rotate said body.

16. The waste ink accumulation system of claim 15, wherein said ink-collecting surface is substantially planar.

17. The waste ink accumulation system of claim 15, wherein said ink-collecting surface is substantially circular.

18. A waste ink accumulation system in an ink jet printer, said system comprising:

a body having an ink-collecting surface, said body being rotatable about an axis substantially perpendicular to said ink-collecting surface; and an actuating mechanism configured to rotate said body, wherein said body has a second surface opposite said ink-collecting surface, said system further comprising a ring-shaped device engaging said second surface and configured to support said body against a fixed surface.

19. The waste ink accumulation system of claim 18, wherein said ring-shaped device is concentric relative to said body.

20. The waste ink accumulation system of claim 18, wherein said body includes a center post extending from said second surface and configured to be connected to the fixed surface.

* * * * *